US007827630B2

(12) United States Patent
Bostelman et al.

(10) Patent No.: US 7,827,630 B2
(45) Date of Patent: Nov. 9, 2010

(54) HOME LIFT POSITION AND REHABILITATION (HLPR) APPARATUS

(76) Inventors: Roger Bostelman, 100 Bureau Dr., Mail Stop 8230, Gaithersburg, MD (US) 20899-8230; James Albus, 9520 W. Stanhope Rd., Kensington, MD (US) 20895

( * ) Notice: Subject to any disclaimer, the term of this patent is extended or adjusted under 35 U.S.C. 154(b) by 120 days.

(21) Appl. No.: 12/336,154

(22) Filed: Dec. 16, 2008

(65) Prior Publication Data

US 2009/0144895 A1 Jun. 11, 2009

Related U.S. Application Data

(60) Provisional application No. 61/023,567, filed on Jan. 25, 2008.

(51) Int. Cl.
*A61G 7/10* (2006.01)

(52) U.S. Cl. ..... 5/87.1; 5/86.1; 5/83.1

(58) Field of Classification Search ..... 5/87.1, 5/86.1, 11, 83.1, 85.1; 414/921; 280/304.1; 180/19.3, 19.2, 333, 332
See application file for complete search history.

(56) References Cited

U.S. PATENT DOCUMENTS

| | | | | |
|---|---|---|---|---|
| 3,962,737 | A | 6/1976 | James | |
| 4,290,423 | A | 9/1981 | Kleinwolterink | |
| 4,399,572 | A * | 8/1983 | Johansson | 5/87.1 |
| 4,483,405 | A | 11/1984 | Noda | |
| 4,719,655 | A | 1/1988 | Dean | |
| 4,999,862 | A | 3/1991 | Hefty | |
| 5,137,102 | A | 8/1992 | Houston | |
| 5,319,813 | A * | 6/1994 | DiMatteo et al. | 5/81.1 C |
| 5,388,289 | A * | 2/1995 | Casperson | 5/86.1 |
| 5,411,044 | A | 5/1995 | Andolfi | |
| 5,520,403 | A | 5/1996 | Bergstrom | |
| 5,694,654 | A | 12/1997 | Roy | |
| 5,758,371 | A * | 6/1998 | VanDyke et al. | 5/86.1 |

(Continued)

FOREIGN PATENT DOCUMENTS

EP 0689410 B1 11/1996

OTHER PUBLICATIONS

U.S. Appl. No. 11/753,299, filed Dec. 6, 2007, Kio, Jonathan M.

(Continued)

*Primary Examiner*—Robert G Santos
*Assistant Examiner*—Brittany M Wilson
(74) *Attorney, Agent, or Firm*—Absolute Technology Law Group LLC

(57) ABSTRACT

The invention disclosed herein is a novel Home Lift Position and Rehabilitation (HLPR) apparatus designed to provide stable movement along several critical axes of motion including lift capability. The HLPR apparatus is capable of moving along a desired floor path ("x-axis"), moving on a vertical axis to lift a patient ("z-axis"), rotating the HLPR apparatus itself (along an "outer rotational axis"), and rotating a patient within the HLPR apparatus while the HLPR apparatus itself remains stationary (along an "inner rotational axis"). The telescoping, double-nested C-frame structure of the HLPR apparatus and pivot assembly allow any patient support structure known in the art to be suspended securely and to move in a stable, torque-resistant manner to assist patients in rehabilitation and in independently performing activities of daily living.

36 Claims, 13 Drawing Sheets

U.S. PATENT DOCUMENTS

| | | | | |
|---|---|---|---|---|
| 5,809,591 | A | 9/1998 | Capaldi | |
| 5,810,104 | A * | 9/1998 | Campbell | 180/19.3 |
| 5,875,501 | A * | 3/1999 | Jury | 5/81.1 R |
| 6,092,247 | A | 7/2000 | Wilson | |
| 6,276,006 | B1 | 8/2001 | Hoit | |
| 6,430,761 | B1 | 8/2002 | Brandorff et al. | |
| 6,585,474 | B1 | 7/2003 | Kameda | |
| 6,637,610 | B1 | 10/2003 | Cheeseboro | |
| 6,932,369 | B2 | 8/2005 | Walsh | |
| 7,360,262 | B2 | 4/2008 | Mowery | |
| 2004/0148699 | A1 * | 8/2004 | Fernie et al. | 5/86.1 |
| 2007/0294823 | A1 * | 12/2007 | Hay | 5/86.1 |

OTHER PUBLICATIONS

Bostelman, Roger & Albus, James, "HLPR Chair 1*—A Service Robot for the Healthcare Industry," ASER 06, Vienna, Austria, Jul. 7, 2006.

Bostelman, R. & Albus, J., "Recent Developments of the HLPR Chair 1," 10th International Conf. on Rehab. Robotics (ICORR 2007), Noordwijk aan Zee, The Netherlands, Jun. 13-15, 2007.

Bostelman, R. & Albus, J., A Novel Patient Mobility and Rehabilitation Robot, 13th IASTED Int'l Conf. on Robotics and Applications 2007 (RA07) Wurzburg, Germany, Aug. 29-31, 2007.

Bostelman, R. & Albus, J., HLPR Chair: A Novel Indoor Mobility-Assist and Lift System.

Bostelman, R. & Albus, J., "A Multipurpose Robotic Wheelchair and Rehabilitation Device for the Home, HLPR Chair 1", IROS 07, San Diego, CA, Oct. 2007.

Bostelman, R. & Albus, J., Petra 08, Athens, Greece, Jul. 2008, Sensor Experiments to Facilitate robot use in Assistive Environments, HLPR Chair 1, 2 + new video.

Bostelman, R. & Albus, J., "HLPR Chair—A Novel Patient Transfer Device, HLPR Chair 1, 2," PerMIS 08, NIST Gaithersburg, MD, Aug. 21, 2008.

Bostelman, Roger & Albus, James, "A Robotic Patient Transfer and Rehabilitation Device for Patient Care Facilities or the Home,"Advanced Robotics Journal, Jun. 2008.

Bostelman, Roger & Albus, James, "Robotic Patient Lift and Transfer" ITech Service Robotics Book Chapter, Sep. 2008.

Bostelman, Roger & Albus, James, "Survey of Patient Mobility and Lift Technologies: Toward Advancements and Standards, Dec. 2006—HLPR Chair 1", NIST Internal Report.

Bostelman, Roger & Albus, James, "Design of the HLPR Chair-HLPR Chair 1, 2," Jun. 19, 2007.

"Robot Wheelchair May Give Patients More Independence," TechBeat, NIST, Sep. 28, 2006.

FedBizOps, Nov. 17, 2006, HLPR Chair public disclosure requesting collaborations.

Bostelman, Roger & Albus, James, Invention Disclosure, Sep. 27, 2007.

Andel, Tom, Modem Materials Handling-News, Mar. 4, 2008, "AGVs applying for healthcare duty; Patient lift and transfer may be the job for next-generation guided vehicles".

Assistive Technologies, Jun./Jul. 2008; HLPR chair in final stages of research.

* cited by examiner

HOME LIFT POSITION AND REHABILITATION (HLPR) APPARATUS

CLAIM OF PRIORITY

This application claims priority to U.S. Patent Application No. 61/023,567 filed Jan. 25, 2008.

STATEMENT REGARDING FEDERALLY SPONSORED RESEARCH OR DEVELOPMENT

The invention described herein was made by employees of the United States Government and may be manufactured and used by or for the Government for Government purposes without the payment of any royalties.

FIELD OF INVENTION

This invention relates generally to the field of assistive and rehabilitative technologies, and in particular to a versatile apparatus which provides lift capabilities and torque-resistant axial movement which can be used with a variety of patient transfer devices.

SUMMARY OF INVENTION

The invention disclosed herein is a novel Home Lift Position and Rehabilitation (HLPR) apparatus that provides stable movement along several critical axes of motion, as well as vertical lift capability. The HLPR apparatus is capable of moving along a desired floor path ("x-axis"), moving on a vertical axis to lift a patient ("z-axis"), rotating the HLPR apparatus itself (along an "outer rotational axis"), and rotating a patient within the HLPR apparatus while the HLPR apparatus itself remains stationary (along an "inner rotational axis"). The telescoping, double-nested C-frame structure of the HLPR apparatus and pivot assembly allow any patient support structure known in the art to be suspended securely and to move in a stable, torque-resistant manner to assist patients in rehabilitation and independently performing activities of daily living, and to assist caregivers in patient lift and transfer activities. Patient support structures may include seats, beds, gurneys, slings, examining tables, operating tables, platforms, etc. Various embodiments of the HLPR apparatus disclosed herein may further a retractable seat assembly and a retractable footrest assembly, which may be powered by multiple pistons, motors, hydraulic motors, gears, pulleys and other actuator devices known in the art. The HLPR apparatus may include optional patient support accessories (e.g., slings, straps, buttock support straps, suspended straps, torso lifts, arm rests, headrests, bars and contoured structures) adapted to facilitate patient lift and transfer. Embodiments of the HLPR apparatus may include varying levels of control and autonomous systems, including but not limited to sensors, joysticks, computer interfaces, sip-and-puff devices and voice activated controls to automate the basic functionality of the HLPR apparatus disclosed herein.

BACKGROUND

There is an impending crisis in the health care field due to rapid growth of the elderly population relative to the number of care providers available to assist them. In 1950. the ratio of working adults to elderly persons was 8:1. This projected ratio will decline to 5:1 by 2020, and by 2050, it will drop to only three working adults per elderly person. It is thus critical to develop technologies that maximize patient independence and caregiver efficiency. It is also important to minimize stress placed upon caregivers in both domestic and institutional settings.

The primary physical stress imposed on a caregiver (in residential, institutional and emergency settings) occurs when the caregiver is required to lift and transfer patients (e.g., from a wheel chair to a toilet or bed). Risk of injury increases when the patient is relatively large, or the caregivers themselves have a predisposition to injury. One out of three nurses is injured from the physical exertion of transferring patients, costing their employers an estimated $35,000 to $50,000 per injury.

In 2005, the National Institutes of Standards and Technology (NIST) Intelligent Systems Division began conducting research in the area of health care mobility. The NIST Healthcare Mobility Project identified the staggering need for technology to assist with lifting and mobility. In 2004-2006, NIST researchers conducted a survey of available lift and mobility devices summarized in a report submitted by Roger Bostelman and James Albus, *Survey of Patient Mobility and Lift Technologies Toward Advancements and Standards*, NISTIR #7384, 2006.

Further research was presented by Roger Bostelman and James Albus at the 3rd International Workshop on Advances in Service Robotics (ASER06), in Vienna, Austria on Jul. 7, 2006 in a seminal report entitled "*HLPR Chair: A Service Robot for the Healthcare Industry*" ( hereinafter referred to as the "2006 report").

The 2006 report identified standard ranges of motion that would be necessary in a device to assist caregivers in safely conducting patient lift and transfer activities: rotation of an outer frame, rotation of a patient seat within the outer frame, motion along an x-axis (forward and backward axis) and motion along a z-axis (vertical lift). The researchers proposed the design of an apparatus to safely accommodate these ranges of motion using a single device for patients who might be very frail, large in size, or have a wide range of disabilities and physical limitations.

To illustrate how existing technology might be incorporated, the 2006 report discussed a prototype "service robot" utilizing an "off-the-shelf sturdy forklift," which would be "powered similar to typically powered chairs on the market" and a standard "joystick" type steering mechanism. The research paper taught a lift mechanism using "a steel chain fix-mounted at one end to the HLPR chair frame and to the lift plate at the other end." Rollers were mounted to "the lift plate [and] roll inside the HLPR chair." The roller configuration later proved unfeasible, and numerous safety issues were identified.

The 2006 report explained that the prototype would operate as follows in transferring a patient from the chair to a toilet:

> To place a HLPR Chair user on another seat, they can drive to for example: a toilet, seat, or bed. Once there, the HLPR Chair rotates the footrest up and beneath the seat and the patient's feet are placed on the floor personally or by a caregiver. The HLPR Chair inner L-frame can then be rotated manually with respect to the chair frame allowing the patient to be above the toilet. Padded torso lifts then lift the patient from beneath his/her arm joints similar to crutches. The seat, with the footrest beneath, then rotates from horizontal to vertical behind the patients back clearing the area beneath the patient to be placed on the toilet, seat, bed, etc.
>
> Once the person is in place on the toilet, the HLPR Chair can remain in the same position to continue supporting them from potential side, back or front fall.

Thus, in addition to identifying the movement axis that would be required for an HLPR chair, the 2006 report taught a footrest mechanism that would move out of the way and also a mechanical "torso lift" component to lift the patient out of the chair.

While these concepts were intriguing to the health care community, there was consensus that the prototype did not enable or teach the design of a safe, commercially viable apparatus. Further research would be needed. For example, the "padded torso lifts" deployed by a "torso lift actuator" which would pull patient up by their arm joints and suspend them in this manner above a surface, such as a toilet, were an unsafe way of suspending a patient—particularly a large or frail one. The torso lifts would place considerable stress on the patient, while their lower body would be dangerously unsupported. Thus, it was a challenge to develop a device that would lift and suspend a patient without injuring them.

Additionally, the 2006 report proposed the concept of a chair seat that could actually rotate from beneath a patient "from horizontal to vertical." There was consensus in the medical community that this would indeed be a desirable feature. However, a seat that would fit within a fork-lift type frame would need to be compact and custom-made to rotate and clear the outer frame of the device. The seat would also have to efficiently reposition itself from a vertical to horizontal position, or there would be great risk to the patient. The seat would also have to accommodate the weight and width of larger patients, and be of sufficient length to prevent patients with poor motor control from simply falling off the front edge.

Just as importantly, to be commercially viable, an HLPR seat would need to accommodate the heights of structures (e.g., chairs, toilets and beds) without requiring exact and complex adjustments. The seat would need to retract completely, allowing for height variances and contouring in the structure that could interfere with the full range of necessary motion in the seat.

Finally, a commercially viable HLPR device would need to resist destabilizing torque forces caused by the motion of both the seat and the patient, yet be light enough to be moved and manipulated by caregivers and transported for commercial and residential use. The welded aluminum frame of the initial prototype was unwieldy, costly to produce, and heavy to transport and manipulate. Yet the 2006 report still expressed the concern that "[h]eavier patients would require additional counterweight" to provide stability and counter torque forces during rotation, if the patient leaned forward or if the HLPR was moving forward or down a slope.

Despite these formidable design obstacles, the 2006 report contemplated that a safe device could be manufactured for approximately $10,000. and could be sold to medical equipment rental companies for less than $30,000. If rented for $100 per day, each device could pay for itself in less than a year.

Moreover, the 2006 report contemplated that an HLPR apparatus should not be limited to use by patients in a sitting position, and that it would be desirable to design a versatile device that would enable a wider range of support and lift functions, including rehabilitative functions to assist semi-mobile and ambulatory patients.

The 2006 report led to additional research to develop an affordable apparatus to perform lift, transfer and rehabilitative activities. This research has also been directed at facilitating patient transfer and lift in emergency, institutional and rehabilitative settings.

GLOSSARY

Figure 1B:
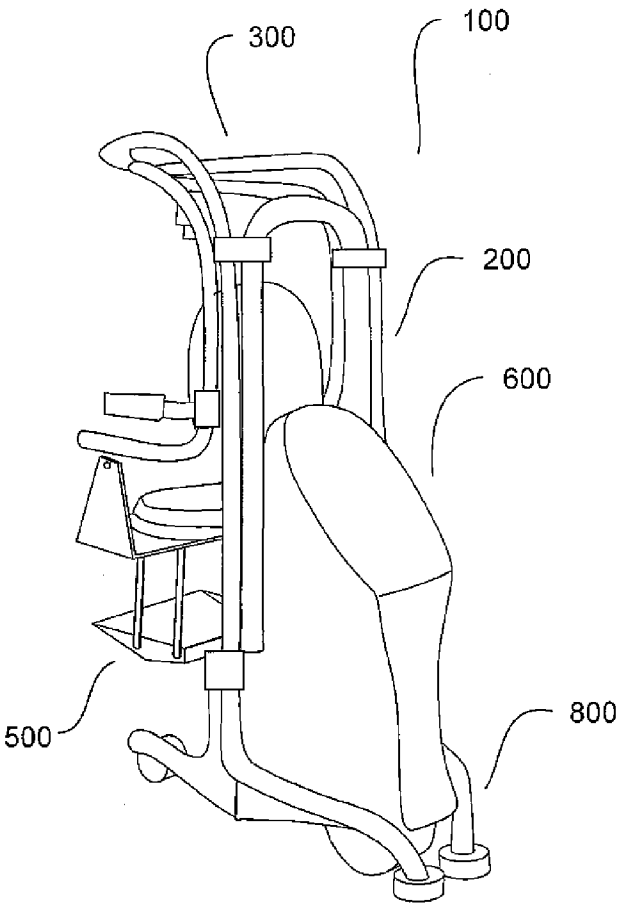
FIG. 1*b* illustrates a back view of an exemplary embodiment of an HLPR apparatus.

As used herein, the term "actuator" is a mechanism to introduce motion or to create a force or counter-force. Examples of actuators include but are not limited to electric actuators, motors, hydraulic cylinders, linear actuators, etc.

As used herein, the term "assembly" means multiple component parts which work in conjunction to perform a function (e.g., pivot assembly, cable and winch assembly, seat assembly, wheel assembly and spring assembly).

As used herein, the terms "autonomous" or "automated" mean any movement, functionality, sensing capability, path alteration, retraction or extension of components which is initiated, carried out and/or terminated without direct input by a patient or caregiver.

As used herein, the term "bearing ring" means a structure to permit constrained relative motion between two parts, typically rotation or linear movement.

As used herein, the term "cable and winch" assembly means a mechanical lift component that includes a winch, pulley and/or cables that may be suspended from an overhead frame component.

As used herein, the term "control set" is any device known in the art which provides controlling a steering wheel assembly, a hydraulic device, a motor, an actuator a sensor or a mechanical component, and combinations thereof.

As used herein, the term "control redundancy" means multiple control sets which perform the same functions (e.g., a patient and caregiver control set).

As used herein, the term "drive motor" means a motor which is used to power or propel an HLPR device.

As used herein, the term "drive wheel" means a wheel which is used to steer or determine direction. (A non-drive wheel may or may not include this functionality.)

As used herein, the term "encoder" means a rotation measurement sensor.

As used herein, the term "extended z-axis" means a path of movement which extends beyond the original height of an HLPR apparatus, and which is generally achieved by a telescoping, double nested C-frame structure which is a component of the HLPR apparatus.

As used herein, the term "inner curved tubular patient support frame" provides support for a patient support structure. An inner curved tubular patient support frame may, in various embodiments, be pivotally attached an outer curved tubular base frame. It may be constructed as a hollow or solid tubular structure of any number of components, using steel, aluminum, other metal alloys, wood, fiberglass or any other material in the art known for forming a support frame.

As used herein, the term "foot rest sensor" means any device which detects the motion or position of a foot rest.

As used herein, the term "inner rotational axis" means the axis of rotation of a patient support structure within an HLPR apparatus, while the HLPR apparatus remains substantially stationary.

As used herein, the term "lift plate" is a structure to which a patient support component is attached, and which is moved in by an actuator.

As used herein, the terms "nurse control panel" or "caregiver control panel" mean a control panel or device which is used by a person other than the patient to control an HLPR apparatus independently of the patient.

As used herein, the term "outer curved tubular base frame" support components of an HLPR apparatus and interfaces with the wheel or wheel assembly component. It may further support an inner curved tubular base frame. An outer curved tubular base frame may be constructed as a hollow or solid tubular structure of any number of components, using steel, aluminum, other metal alloys, wood, fiberglass or any other material in the art known for forming a support frame.

As used herein, the term "outer rotational axis" means the rotational axis or movement of an HLPR apparatus.

As used herein, the term "patient support accessory" means a component used to support or suspend a patient during a lift or transfer activity including but not limited to a sling device, torso lift, strap, strap configuration, rigid contoured support component, brace and suspended strap.

As used herein, the term "patient support structure" means any device known in the art to passively support the total or partial weight of a patient, including but not limited to a chair, seat, bed, table, examination table, gurney, cot, platform, hammock, sling support, sling support configuration, surgical table, partial seat support apparatus, walker, arm rest, and combinations thereof.

As used herein, the term "patient transfer activity" means any activity during which a physically compromised patient must be transferred from one location or surface to another with the assistance of a caregiver.

As used herein, the term "pivot assembly" means a structure which provides rotational capability for one or more component parts of an HLPR apparatus.

As used herein, the term "seat sensor" means any device which detects the motion or position of a seat.

As used herein, the term "spring assembly" means a structural component which includes one or more springs which creates a force when released.

As used herein, the term "strengthening plate" means a structural component of any shape or dimension to reinforce a structure and/or increase its load bearing capability.

As used herein, the term "support plate" means a plate which provides structural support.

As used herein, the term "torque" shall include all forces attributable to rotational motion of a component of an HLPR apparatus, including but not limited to pitch and roll forces.

As used herein, the terms "torque resistant" or "torque resistance" mean a structure capable of maintaining stability and functionality despite torque forces.

As used herein, the term "telescoping" means any structure which may be extended or retracted.

As used herein, the term "torso lift" means a device which provides lift assistance to a patient and from under the patient's armpits whether lifting directly from the armpits or from some other torso-attached strap or belt.

As used herein, the term "torque resistant" means any structure which is constructed to resist torque forces.

As used herein, the term "track structure" means a fitted structural component which can be moved along the surface of another track structure.

As used herein, the term "tubular shaft" is any hollow or solid elongated structure.

As used herein, the term "wheel assembly" means one or more wheels, and/or a configuration of wheels and component parts to house, stabilize and control said wheels.

As used herein, the term "x-axis" means a horizontal path of movement.

As used herein, the term "z-axis" means a vertical path of movement.

DETAILED DESCRIPTION OF EMBODIMENTS OF THE INVENTION

For the purpose of promoting an understanding of the present invention, references are made in the text hereof to embodiments of a Home Lift Position and Rehabilitation ("HLPR") apparatus, only some of which are described herein. It should nevertheless be understood that no limitations on the scope of the invention are thereby intended. One of ordinary skill in the art will readily appreciate that modifications such as the dimensions of the HLPR apparatus, alternate but functionally similar material(s) from which the HLPR apparatus is made, and the inclusion of additional elements are deemed readily apparent and obvious to one of ordinary skill in the art, and all equivalent relationships to those described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the HLPR apparatus as disclosed herein includes multiple motorized actuators and a joystick control. Other embodiments may include more or fewer motorized components, actuators, computer interface components or may include various means to facilitate autonomous movement while having the same function and features of the invention described herein.

Figure 1A:
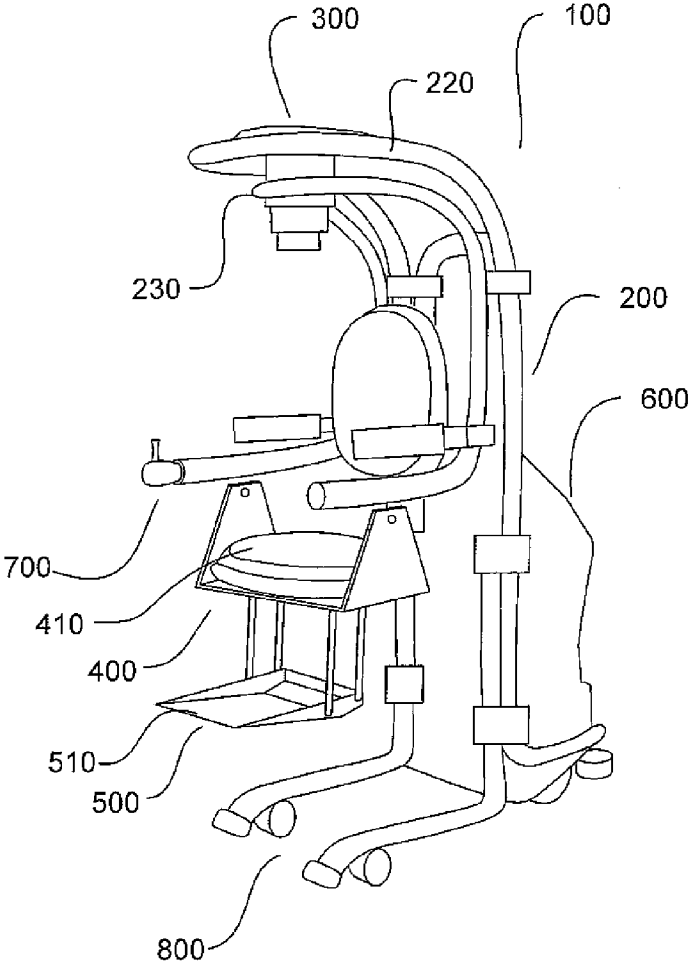
FIG. 1*a* illustrates a front view of an exemplary embodiment of an HLPR apparatus.

FIG. 1*a* and FIG. 1*b*. respectively, illustrate a front and back perspective view of one exemplary embodiment of HLPR apparatus 100. HLPR apparatus 100 provides a patient with the ability to move along a minimum of four critical axes. These axes of motion provide mobility for indoor tasks, lift assistance and rehabilitative support. The axes of motion are accomplished using telescoping, double nested C-frame structure 200, which is unique to the HLPR apparatus 100. Telescoping, double nested C-frame structure 200 is comprised of outer curved tubular base frame 220 and inner curved tubular patient support frame 230, which support patient seat assembly 400.

Using HLPR apparatus 100 a patient may move in a forward and backward direction or along any horizontal path ("x-axis") and may rotate the entire apparatus at a pivot point above the wheel base ("outer-rotational axis"). A patient may also rotate inner curved tubular patient support frame 230 from which seat assembly 400 and seat 410 are suspended ("inner rotational axis"). Additionally, HLPR apparatus 100 provides lift capability to move a patient in a vertical path ("z-axis").

In the embodiment shown, patient seat assembly 400 includes patient support structure generically referred to as seat 410, which is suspended from telescoping, double nested C-frame structure 200. However, any patient support structure known in the art may be suspended from telescoping, double nested C-frame structure 200. In various embodiments, seat 410 may be a gurney, cot, platform, hammock, sling support configuration, examining table, surgical table, partial seat support apparatus and/or various devices to support an ambulatory patient while walking. Seat 410 may be modified or replaced by any structure known in the art which may be adapted to fully or partially support the weight of a patient.

In the embodiment shown, patient lift capability is achieved by use of lift actuator 229 and one or more winches, cables and pulley systems (which are illustrated in more completely FIG. 6). In the embodiment shown, lift actuator 229 can support 681 kg (1500 Lbs). In other embodiments, lift actuator 229 can be replaced a higher capacity unit if needed. In the embodiment shown, lift actuator 229 is connected to lift plate (illustrated in FIG. 6). Lift actuator 229 pushes up on a sprocket of which a chain rolls over providing 0.9 m (36 in) lift with only 0.45 m (18 in) of chain (as illustrated in FIG. 6).

FIGS. 1*a* and 1*b* also show pivot assembly 300 which allows inner curved tubular patient support frame 230 to pivot in a stable and torque resistant manner within outer curved tubular base frame 220 to rotate the direction of seat 410 without moving the location of the HLPR device. In the exemplary embodiment shown, outer curved tubular base frame 220 measures 58 cm (23 in) wide by 109 cm (43 in) long by 193 cm (76 in) high (when not in the lift position) making it small enough to pass through even the smallest, typically 61 cm (24 in) wide by 203 cm (80 in) high, residential bathroom doors. However, in various embodiments, the dimensions of outer curved tubular base frame 220 and inner curved tubular patient support frame 230 may vary substantially to support a wide range of patient support structures.

In the embodiment shown in FIG. 1*a* and FIG. 1*b*. outer curved tubular base frame 220 and inner curved tubular patient support frame 230 are constructed of torque-resistant hollow bent metal tubing, steel or steel alloy. In other embodiments, outer curved tubular base frame 220 and inner curved tubular patient support frame 230 may be aluminum, fiberglass, metal alloy or any other material known in the art which may be formed and functionally adapted to form components of telescoping, double nested C-frame structure 200. The hollow or substantially hollow tubing structure increases the torque resistance of HLPR apparatus 100.

In various embodiments, outer tubular base frame 220 and inner curved tubular patient support frame 230 may be constructed of solid, hollow or partially hollow tubing members, and may be constructed of any number of tubing components. More or fewer tubing components may be used in the construction and design of telescoping, double nested C-frame structure 200 and to facilitate assembly and transport, and allow alternate configurations of telescoping, double nested C-frame structure 200. For example, additional tubular components may be used to add to the width or height of outer tubular base frame 220 and inner curved tubular patient support frame 230. Additional tubular components may be used to adapt HLPR apparatus 100 for affixation of additional or alternate components to telescoping, double nested C-frame structure 200 (such as bed, hammock, body sling support configuration, or components to support an ambulatory patient while walking). The use of standardized tubular components may result in modular and customized manufacturing of HLPR apparatus 100, and resultant efficiencies in manufacturing of a diverse product line of the HLPR apparatus 100. The use of square or irregularly shaped tubing is also contemplated.

In various embodiments, structural tubing support components (not shown) may be used to minimize the diameter of the tubing necessary to provide adequate torque resistance support for HLPR apparatus 100. These tubing support components may be incorporated by welding, manufacturing or other means and shall be considered an integral component of the tubing. For example, in the embodiment shown in FIGS. 1*a* and 1*b*. steel ribs may be welded at various intervals to the tubing.

FIGS. 1*a* and 1*b* include seat assembly 400, comprised of multiple components (discussed in more detail in FIGS. 8, 9*a*. 9*b* and 9*c*) which operate to retract and extend seat 410. Also shown is footrest assembly 500, which extends and retracts footrest 510 (further illustrated in FIGS. 7 and 8). For access/exit to/from HLPR apparatus 100, footrest 510 can be retracted beneath the seat. For mobility, footrest 510 is deployed to support the feet. In addition, manually rotated feet pads can be deployed to provide a wider footrest. When retracted, the footrest pads automatically rotate within the footrest volume.

Exemplary control set 700 is also visible in FIG. 1*a*. In the embodiment shown, control set 700 is a commercially available joystick mechanism. In other embodiments, control set 700 may include a keyboard, computer interface, sip-and-puff device, a variety of wheel and caster configurations or any mechanism known in the art for controlling or steering wheel assembly 800 or one or more hydraulic components.

In the embodiment shown, wheel assembly 800 is a three-wheel "tricycle" designed to simplify the steering and drive linkages and provide a compact drive system for HLPR apparatus 100. Steering is accomplished by a single wheel design with a hard stop beyond ±90 deg for safety of the steering system controlled by control set 700, where left rotates the drive wheel counterclockwise, and right clockwise.

In the embodiment shown, HLPR apparatus 100 further includes two casters mounted to outer base frame extensions 220. The base frame extensions create a wider rear stabilizing frame and prevent HLPR apparatus 100 from tipping. The casters are mounted above the floor height and in-line with the rear drive/steer wheel so as to not cause mobility over-constraint on uneven floors. The exemplary embodiment shown in FIG. 1*b* uses drive motor 600 of 112 horsepower, and a motor of 117 horsepower for steering. Drive motor 600 is geared such that its high speed drives a chain-driven wheel providing further speed reduction. The drive speed is variable 0.7 m/s (27 in/s) and can be set to the desired drive speed limited by motor speeds and gearing.

In the embodiment shown, HLPR apparatus 100 further includes switches (not shown) to control seat and footrest retraction or deployment. In various embodiments, control set 700 may include a nurse or caregiver control panel (not shown) that duplicates the patient controls at the seat. The nurse or caregiver control panel includes all the control functions for a nurse or caregiver to drive or lift a patient. Thus, control redundancy is contemplated for various embodiments of HLPR apparatus 100.

Control set 700 may include encoders within telescoping, double nested C-frame structure 200. In this embodiment, the encoders provide approximately 90 pulses/cm of linear travel. In various embodiments, high measurement-accuracy of wheels (not shown) may facilitate accurate path planning and control algorithms for HLPR apparatus 100.

In other embodiments, control set 700 may include autonomous control capability utilizing sensors (not shown) which receive information that is processed using an on-board processing unit. Appropriate navigational trajectories and motor torque inputs may be determined in near real time. The design of control set 700 may adopt the 4D/RCS or other modular control system architectures so that advanced 3D images and control algorithms can be plug-and-played to address the variety of patient mobility needs.

FIG. 1*b* illustrates the positioning of drive motor 600. Drive motor 600 is mounted perpendicular to the floor and above the drive wheel with a chain drive. The steering motor (not shown) is coupled to an end cap on drive motor 600 and provides approximately 180° degrees rotation of the drive wheel to steer HLPR apparatus 100.

Figures 2A, 2B, 2C:
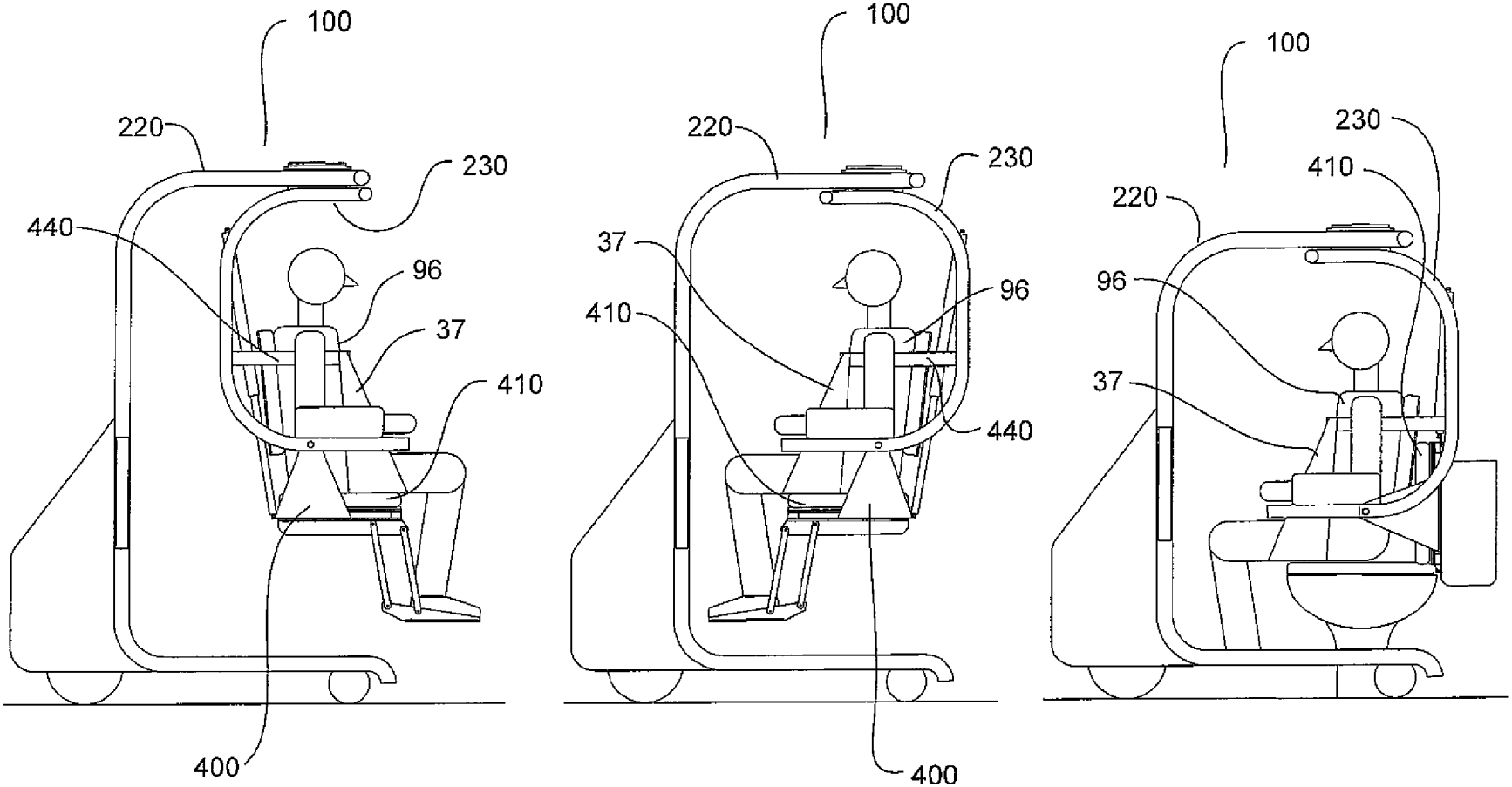
FIGS. 2*a*. 2*b* and 2*c* illustrate three alternate positions of exemplary embodiments of an HLPR apparatus being used to position a patient over a toilet seat.

FIGS. 2*a*, 2*b* and 2*c* illustrate an exemplary embodiment of HLPR apparatus 100 being used to transfer patient 96 onto a surface (e.g., bed, toilet, chair, examining table, etc.).

In FIG. 2*a*, patient 96 or caregiver navigates HLPR apparatus 100 along a path to the desired location along an x-axis, with patient 96 facing forward in the manner of a traditional wheel chair.

Figure 10B:
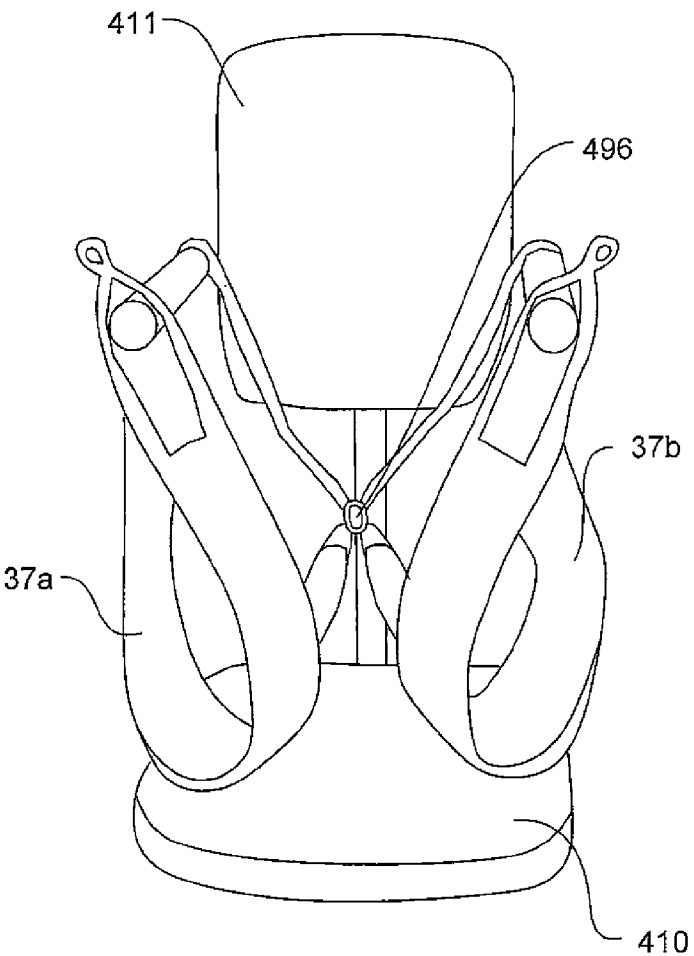
FIG. 10*a* illustrate rigid support structures attached to torso lifts which slide under the patient's legs and/or buttocks to support the patient.
FIG. 10 illustrate sling assemblies which encircle patient's thighs to support the patient.
Figure 10A:
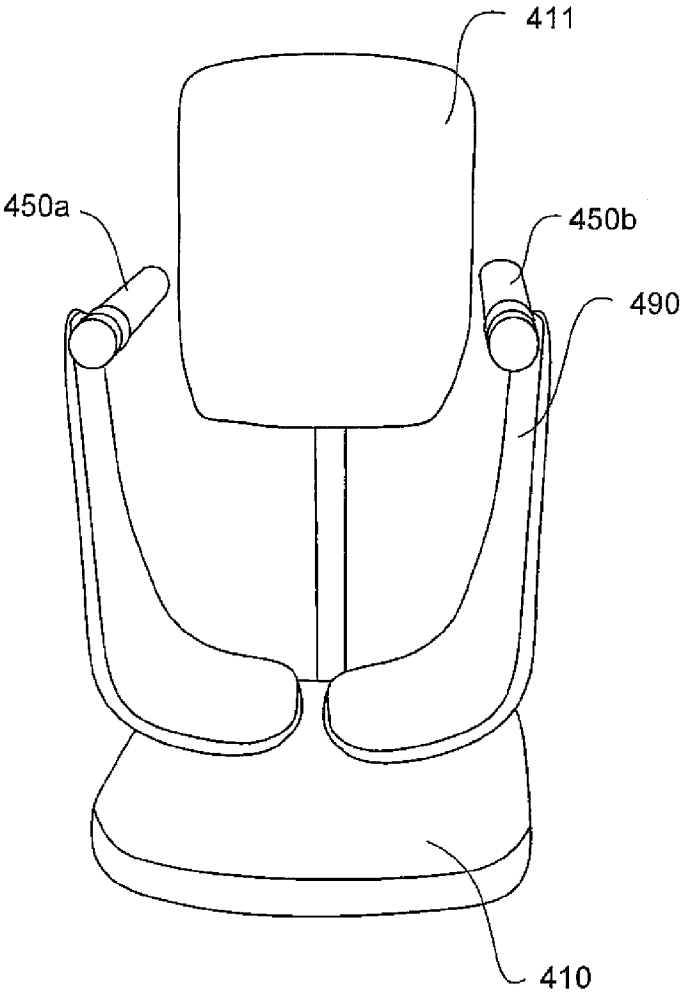

In FIG. 2*b*, the patient or caregiver then rotates inner curved tubular patient support frame 230 manually or with a motor-drive (not shown) facing patient 96 in opposite direction, within the outer curved tubular base frame 220, and with respect to the chair frame positions patient 96 in front of or above a toilet, and facing in the opposite direction. Footrest 510 retracts up and beneath the seat and the patient's feet are placed on the floor by patient 96, or with assistance from caregiver. Optional padded torso lifts 440 and sling and buttock support components (as illustrated in FIGS. 10*a* and 10*b*) may then be used to help lift the patient 96 instead of lifting from only beneath his/her arm joints similar to crutches. Seat assembly 400 rotates seat 410 from a horizontal position beneath the patient to a vertical position relative to inner curved tubular patient support frame 230 and behind patient's back clearing the area beneath patient 96 to be placed on the toilet. Patient 96 is then lowered onto the toilet using lift actuator 229.

Figure 3B:
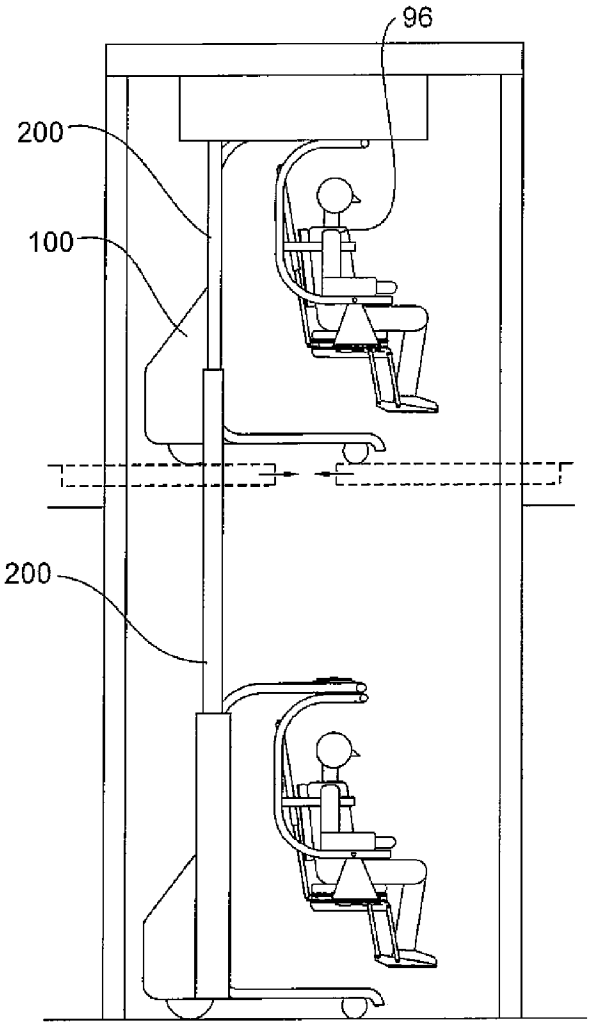
FIGS. 3*a* and 3*b* illustrate alternate uses of exemplary embodiments of an HLPR apparatus capable of movement along an extended z-axis.
Figure 3A:
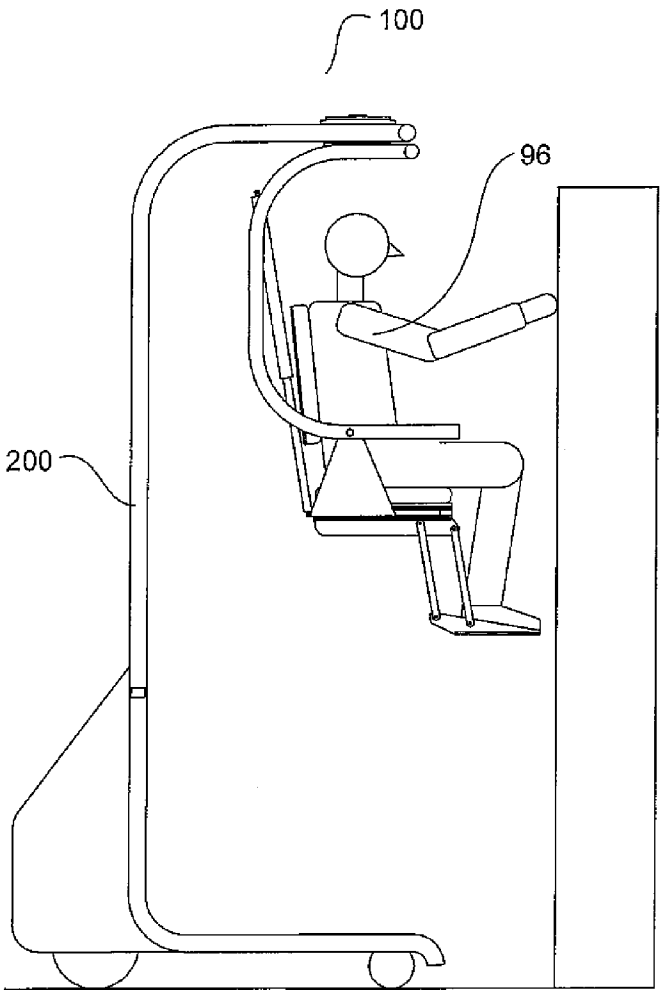

FIGS. 3*a* and 3*b* illustrate HLPR apparatus 100 in use to move patient 96 upward, along an extended z-axis without a caregiver's help or other lift mechanisms. In the embodiment shown, HLPR apparatus 100 is moved along an extended z-axis. Telescoping double nested C-frame structure 200 allows patient 96 to access objects at standing height and above, as shown in FIG. 3*a*, and to be lifted to the second story of a building, as shown in FIG. 3*b*, in which the ceiling is configured with an opening to allow access to an upper floor of the building.

Figure 4:
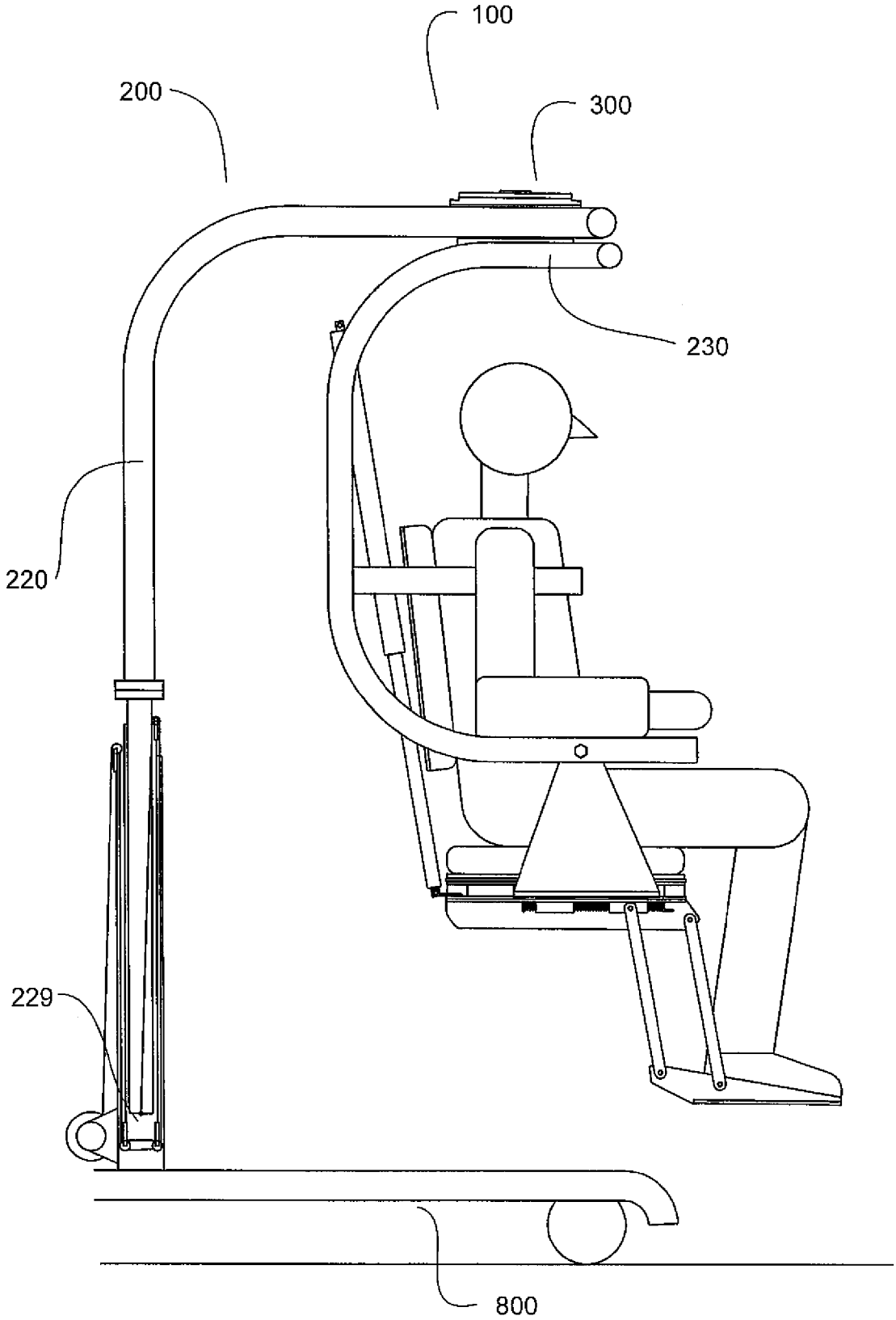
FIG. 4 illustrates a side view of the telescoping double nested C-frame structure, pivot assembly, footrest assembly and wheel assembly of an HLPR apparatus.

FIG. 4 illustrates partial side view of telescoping, double nested C-frame structure 200. As shown in FIG. 4, telescoping, double nested C-frame structure 200 is comprised of outer curved tubular base frame 220 and inner curved tubular patient support frame 230. Outer curved tubular base frame 220 has telescoping capability for movement along a z-axis of a height of up to 3 m (10 ft). Outer curved tubular base frame 220 also houses or is integrally attached to wheel assembly 800.

In the embodiment shown, inner curved tubular patient support frame 230 provides the capability (i.e., sufficient clearance space) for inner rotational axis while outer curved tubular base frame 220 remains stationary. Stability and torque resistance are facilitated by the design of pivot assembly 300

Figure 5A:
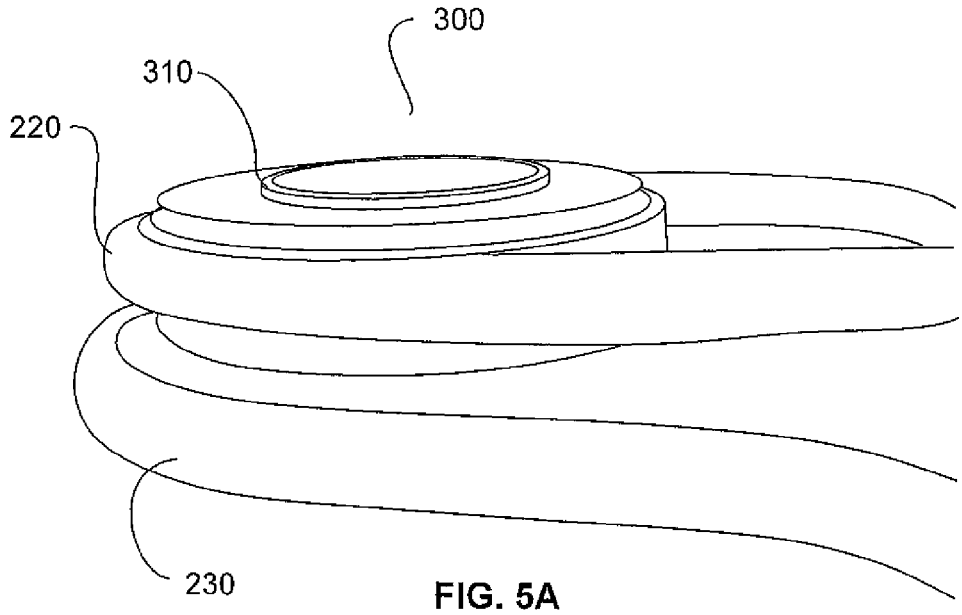
FIG. 5*a* illustrates a side perspective view of a pivot assembly.
Figure 5B:
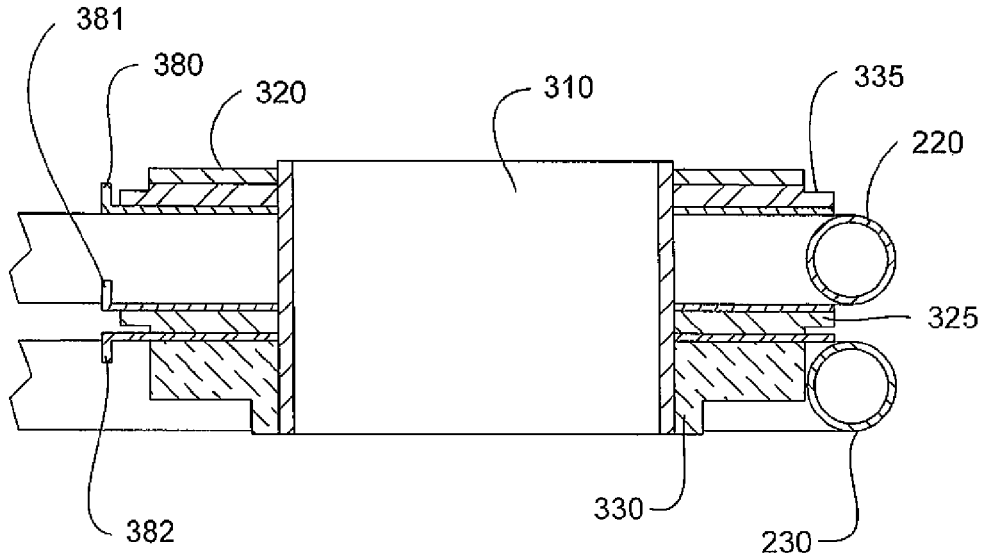
FIG. 5*b* illustrates a sectional side view of a pivot assembly.

FIG. 5*a* illustrates a side view of pivot assembly 300, and FIG. 5*b* illustrates a sectional side view of pivot assembly 300. Pivot assembly 300 is comprised of wide diameter, hollow tubular shaft 310 and pivotal assembly securing component 330, as well as various rings and plates that facilitate torque resistance when patient is rotated using inner curved tubular patient support frame 230 (not shown).

FIG. 5*b* illustrates a sectional side view of pivot assembly 300. In the embodiment shown, tubular shaft 310 is movably inserted in the curvature of outer curved tubular base frame 220 and inner curved tubular patient support frame 230. The curvature is formed by bending the tubing which form of outer curved tubular base frame 220 and inner curved tubular patient support frame 230 which completely or partially encircles and/or supports tubular shaft 310.

Support ring 320 is fixably attached to the upper portion of tubular shaft 310 by welding or other means known in the art, and securely suspends tubular shaft 310, allowing inner curved tubular patient support frame 230 to pivot/rotate on an inner yaw axis in a stable and torque resistant manner.

Tubular shaft 310 may have a diameter ranging from four to forty inches. In various embodiments, tubular shaft 310 may be reinforced by integral structural supports such as ribbing or reinforcing plates. In further embodiments, wiring and cabling may be inserted or encased within tubular shaft 310.

In the embodiment shown, a first optional bearing ring 325 is inserted between the lower surface of outer curved tubular base frame 220 and the upper surface of inner curved tubular patient support frame 230. One or more second optional bearing rings 335 may also be placed between the lower surface of outer curved tubular base frame 220 and the upper surface of inner curved tubular patient support frame 230. Pivot assembly 300 is then secured by pivotal assembly securing component 330, which may be a nut, a bolt, a welded component or any other device known in the art. Surfaces of outer curved tubular base frame 220 and inner curved patient tubular support frame 230, support ring 320 and optional bearing rings 325, 335 may be oiled, treated with a substance or constructed of materials to reduce friction and enhance the pivotal motion, with or without the inclusion of optional bearing rings 325, 335.

In the embodiment shown, support ring 320 is a flat, circular plate with a large center hole. Tubular shaft 310 is a 6-inch diameter steel tube, threaded on one end which passes through and is welded to support ring 320.

In the embodiment shown, outer curved tubular base frame 220 and inner curved tubular patient support frame 230 have optional strengthening plates 380, 381, 382, that are welded to their tops and also include 6-inch diameter holes. First optional bearing ring 325 is positioned between support ring 320 and optional strengthening plate 380. In the embodiment shown, optional bearing ring 325 is an inexpensive, 12" diameter "Lazy Susan" bearing ring simply used as a washer.

The exemplary embodiment illustrated in FIG. 5*a* demonstrates that the novel design of pivot assembly can achieve stability and torque resistance for inner rotational motion using relatively inexpensive parts. Absent the use of pivot assembly 300, a patient leaning his or her body weight to one side during inner rotation could destabilize HLPR apparatus 100. Such torque forces are identified and addressed by the design of pivot assembly 300 and its redundant stabilizing components. It is noted that equivalent structures which have the same stabilizing function as the components of pivot assembly 300 identified herein are contemplated in alternate embodiments of HLPR apparatus 100.

Figure 6A:
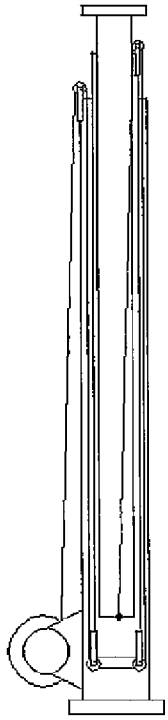
FIG. 6*a* illustrates a side view of a telescoping outer base frame in the retracted position.

FIG. 6*a* is a side view of telescoping outer base frame 220 in the retracted position.

Figure 6B:
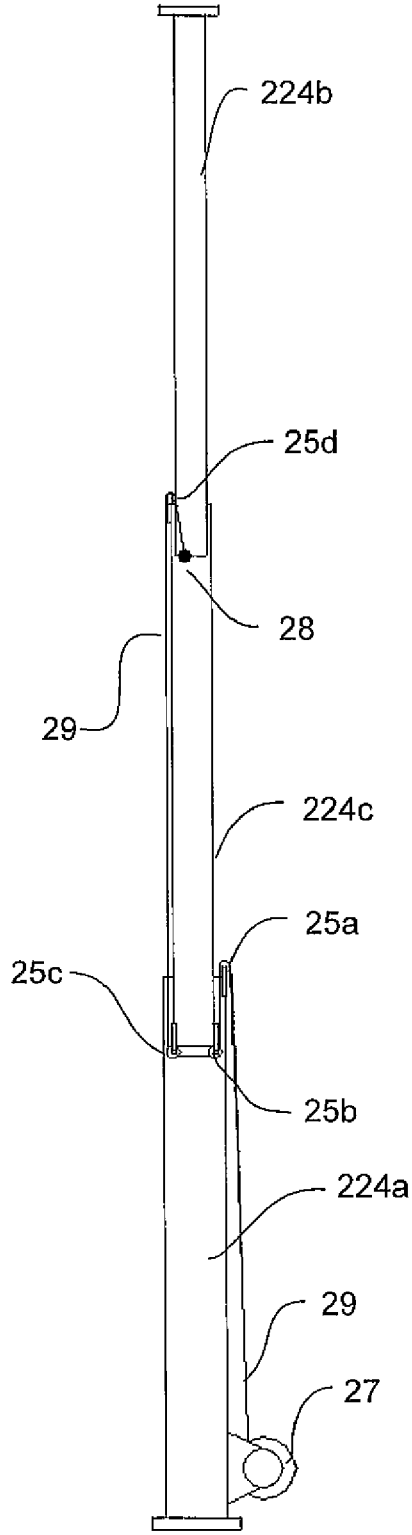
FIG. 6*b* illustrates a side view of the vertical portion of an outer curved tubular base frame in the extended position

FIG. 6*b* is a side view of the vertical portion of outer curved tubular base frame 220 in the extended position that is constructed from at least two separate components: lower vertical frame member 224*a* upper vertical frame member 224*b*. Also shown in FIG. 6*b* is optional center vertical frame member 224*c* which is three feet long in the embodiment shown, but may be of a height ranging from two to five feet. Various embodiments may have more or fewer center vertical frame members 224*c*. The embodiment shown includes pulleys 25*a*, 25*b*,25*c* and 25*d*. Other embodiments may include more or fewer pulleys. Extension winch 27 (which in the embodiment shown is a motor and spool) winds cable 29 over pulleys 25*a*, 25*b*, 25*c* and 25*d*. The end of cable 29 attached to fixed attachment point 28 (e.g. a bolt, protruberance or other structure) on vertical telescoping member 224*b*. When winch 27 is activated, tension is exerted on cable 29, forcing vertical members 224*a*, 224*b* and 224*c* upward. When the tension is released, vertical members 224*a*, 224*b* and 224*c* retract.

Lower vertical frame member 224*a* fits into, interfaces, or is integrally constructed with wheel assembly 800 (not shown). Lower vertical frame member 224*a* may be constructed or contoured to form wheelbase housing 810, or may be fixably attached to wheelbase housing 810 which houses drive wheel 826 and two front wheels 820 and 822.

Figure 7:
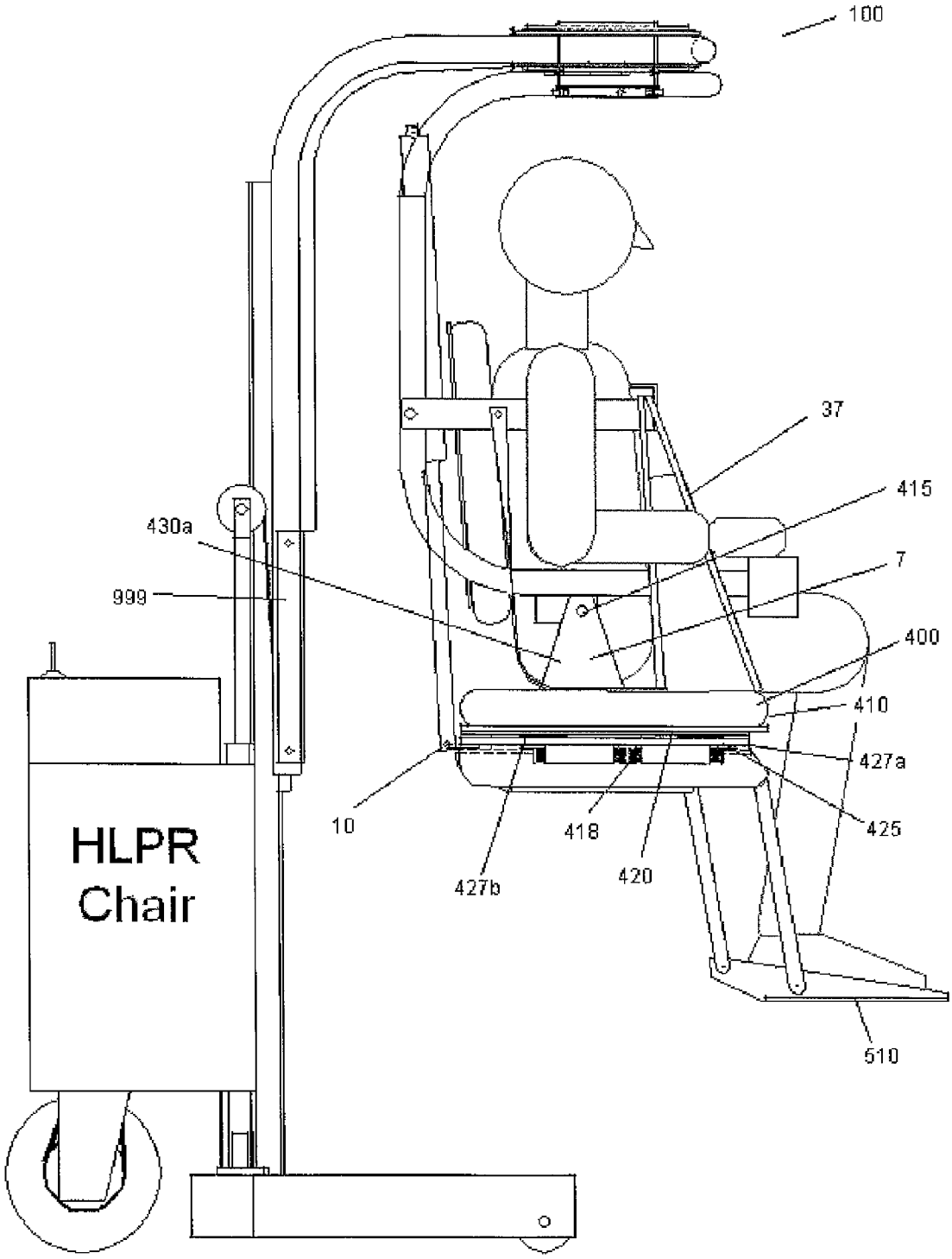
FIG. 7 illustrates a sectional side view of the telescoping double nested C-frame structure, pivot assembly, wheel assembly, footrest assembly and wheel assembly of an HLPR apparatus, in which various internal components are visible.

As shown in FIG. 7, outer curved tubular base frame 220 connects to a lift plate 999 and lift chain which contains lift actuator 229. In the embodiment shown lift actuator 229 exerts a downward force on lower frame 800 pushing up on a pulley over which a chain also fixed at one end to upper frame 800 and the opposite chain end attached to lift plate 999 and serves to raise outer curved tubular base frame 220. The linear actuator is limiting in height dependent upon the chosen actuator. In alternate embodiments, lift actuator 229 may be omitted to allow manual operation of vertical outer frame component 224, or may be an alternate type of actuator, such as a motor, gear, spool, and cable assembly known in the art. For example, alternate embodiments may include a winch, cable and pulley arrangement to lift a series of structural sections which provides lift along an extended z axis.

FIG. 7 is a sectional view of HLPR apparatus 100 that illustrates several internal components of telescoping, double nested C-frame structure 200, seat assembly 400 and footrest assembly 500. Telescoping, double nested C-frame structure 200 components, including outer curved tubular base frame 220 and vertical outer frame component 224 are visible in FIG. 7. Vertical outer frame component 224 is comprised of telescoping components (lower vertical frame member 224*a*. middle vertical frame member 224*c*. and upper vertical frame member 224*b*). Additional or longer middle vertical frame members 224*c* may also be added to increase lift height of double nested C-frame structure 200.

FIG. 7 further illustrates seat assembly 400, which includes seat 410. (Alternate embodiments may include a patient support structure such as a gurney, cot, platform, hammock, sling support configuration similar to sling 37, or components to support an ambulatory patient while walking in various embodiments.) Seat 410 is mounted to seat plate 420 which has an attached track 425. Track 425 is to seat plate 420 and moves over one or more sliding blocks 427*a* and 427*b* (not shown). In the embodiment shown, sliding blocks are bounded by one or more spacers 12*a* and 12*b* (not shown) which allow track 425 to move unobstructed and allow room for spring assembly 418 between triangular seat support 7 and seat plate 420. In the embodiment shown, seat 410 is slidably moved along track 425 by seat actuator 450 when retracting seat 410 from horizontal to vertical positions and by seat actuator 450 and spring assembly 418 from vertical to horizontal (seated) positions.

As shown in FIG. 7, seat plate 420 is attached to seat actuator 450 by actuator attachment 10. Actuator attachment 10, which may be attached to spacers 12*a* and 12*b* (not shown) directly to seat plate 420, or to another structure, is moved manually or by actuator 450. This causes seat 410 to rotate at pivot rods 415. Pivot rods 415 may be bolts, axles, rods or other components known in the art, around which triangular seat supports 430 may pivot. Triangular seat supports 430*a* and 430*b* (not shown) include apertures through which pivot rods 415 are inserted. In the embodiment shown, triangular seat supports 430 are vertical side components of seat plate 420. Triangular seat support 430 is a bent plate that is placed under the seat and configured to form two triangular seat supports (left and right) 430*a* and 430*b*, respectively.

In the embodiment shown, spring assembly 418 exerts a force that causes seat 410 and footrest 510 to slide back into position when returned from a vertical retracted position to a horizontal position and when seat plate 420 is rotated upward. This allows a longer seat to be used than would otherwise be possible with only the motion of seat actuator 450.

In the embodiment shown, HLPR apparatus 100 also includes lift plate 999, which is lifted by a chain or cable attached to a linear electronic piston 998 (not shown). Linear electronic piston 998 is positioned vertically behind outer curved tubular base frame 220.

As illustrated in FIG. 7, outer curved tubular base frame 220 provides a support structure for the patient support components (as further discussed infra). In the embodiment shown, outer curved tubular base frame 220 is bolted to angles welded to the outside of the lift plate 999. In the embodiment shown, lift plate 999 is mounted to outer curved tubular base frame 220 using 4 bolts. A support frame (not shown) is slidably attached to the side of the lift plate 999 facing outer curved tubular base frame 220. Lift plate 999 is positioned within a support frame mount (not shown) attached to support frame 933. The positioning of lift plate 999 within the structure of support frame 933 maximizes the space in which a patient may be rotated on an inner rotational axis using inner curved tubular patient support frame 230, thus providing greater clearance for the patient's knees, legs and feet and allowing for a maximum seat and footrest length. Maximization of seat length and clearance space is important for larger patients to be able to use HLPR apparatus 100.

Figure 8:
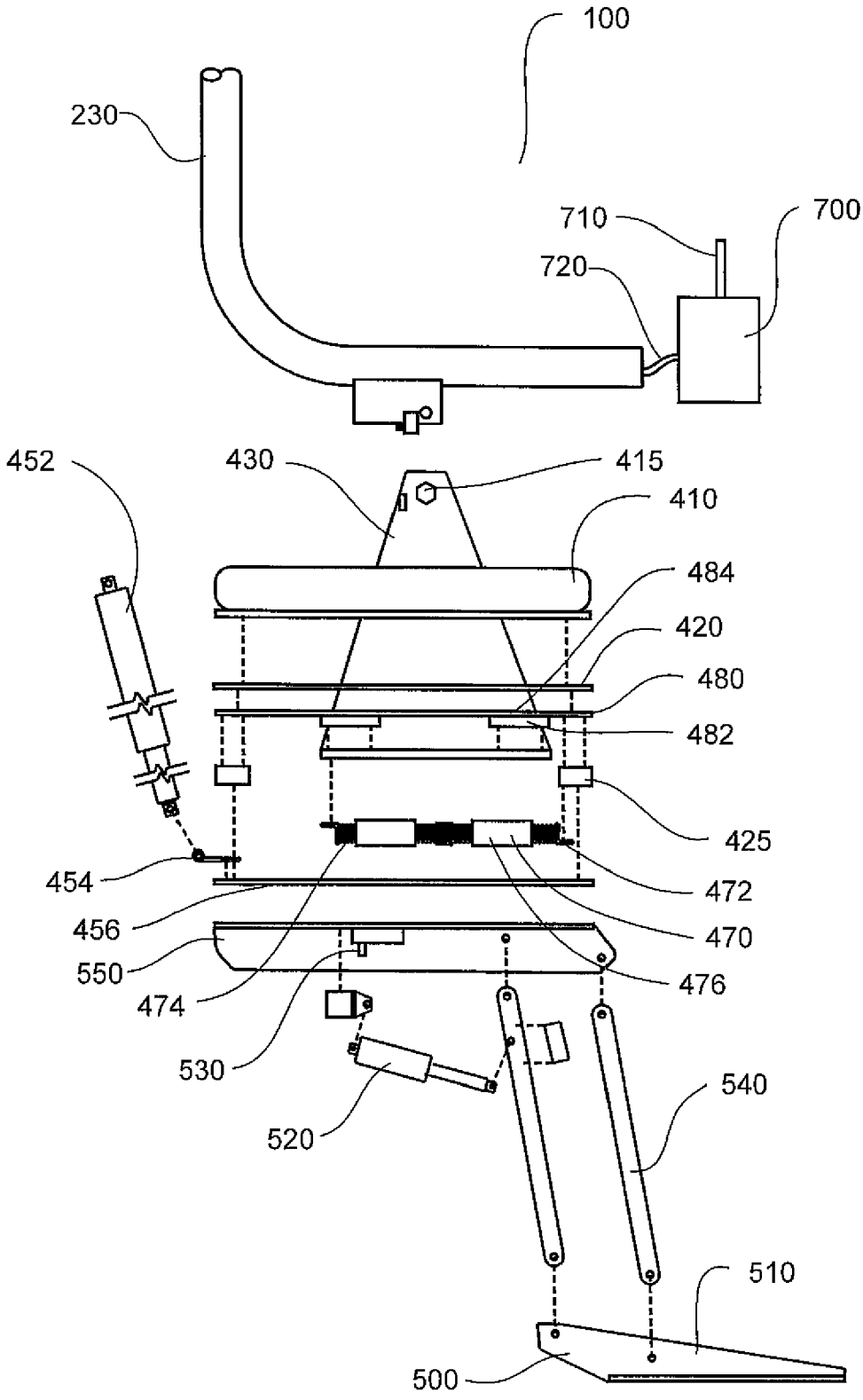
FIG. 8 illustrates an exploded side view of the seat assembly and footrest assembly of an HLPR apparatus, in which various internal components are visible.

FIG. 8 is an exploded side view of seat assembly 400 and footrest assembly 500. Footrest assembly 500 includes footrest actuator 520, which in the embodiment shown is a piston, but may be a manually operated component in other embodiments.

Footrest actuator 520 is connected to footrest actuator bar 530 (not shown) which is attached to footrest bars 540*a* and 540*c* (not shown). Footrest bars 540*a* 540*a*, 540*b*, 540*c*, and 540*d* are pivotally attached to footrest 510, and at their upper end to footrest angle support 560. When footrest actuator 520 exerts a force on footrest actuator bar 530, footrest bars 540*a*, 540*b*, 540*c* and 540*d* are moved upward toward footrest angle support 560. Footrest sensor 580 indicates when footrest 510 is substantially parallel to foot rest angle support 560, and allows seat 410 to retract.

Figure 9C:
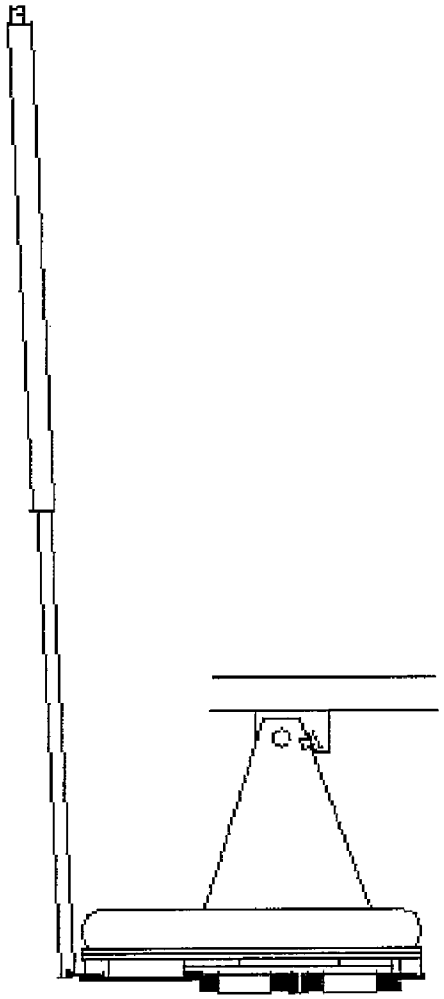
FIG. 9*c* shows the seat in a horizontal retracted position during which the spring assembly provides a horizontal force to slide the seat back into a horizontal extended position.
Figure 9B:
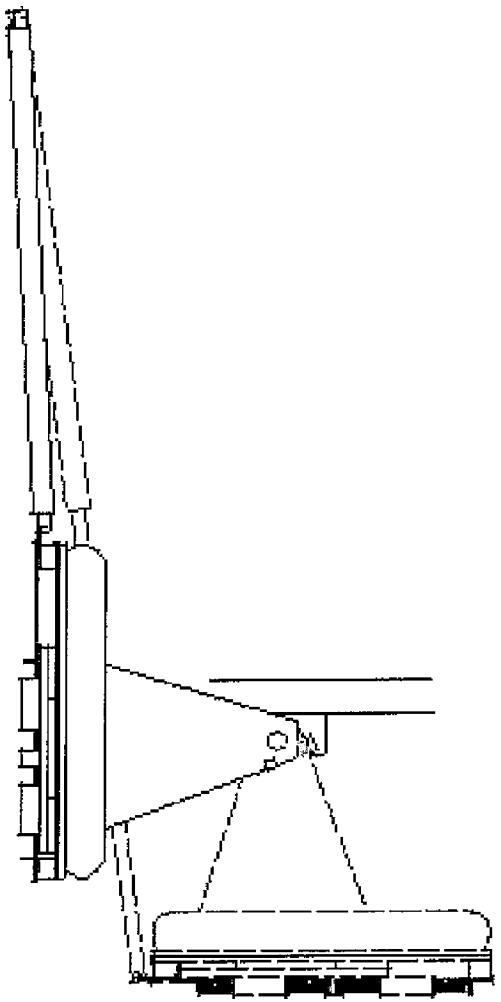
FIG. 9*b* shows the seat in the retracted position, which would allow it to be positioned behind the patient.
Figure 9A:
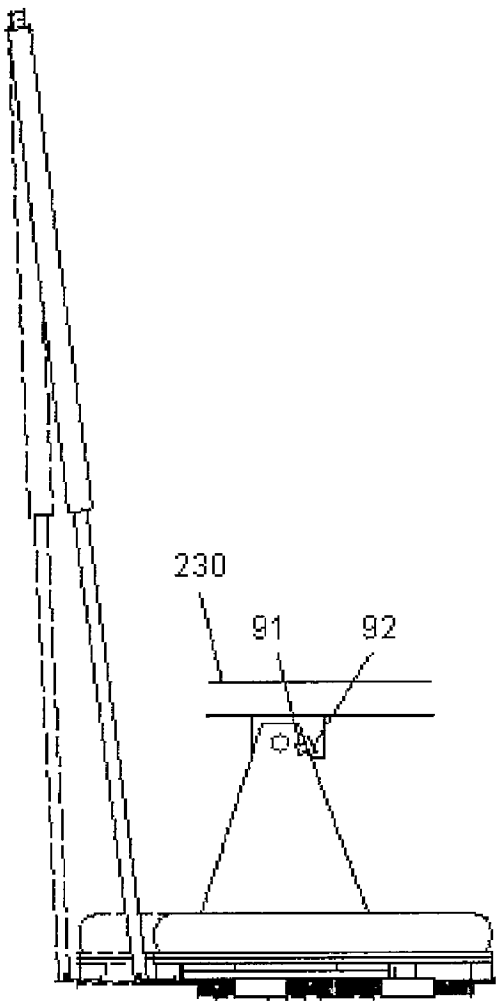
FIG. 9*a* illustrates the seat in a horizontal extended position on which a patient would be seated.

FIGS. 9*a*, 9*b* and 9*c* show seat 410 in three positions. FIG. 9*a* illustrates seat 410 in a horizontal extended position on which a patient would be seated. FIG. 9*b* shows seat 410 in the retracted position, which would allow it to be positioned behind the patient. FIG. 9*c* shows seat 410 in a horizontal retracted position during which spring assembly 418 provides a horizontal force to slide seat 410 back into the a horizontal extended position. When vertically positioned as shown in FIG. 9*b*. seat 410 is moved out of the way for a seated or standing patient, by rotation at pivot points 415.

FIGS. 9*a*, 9*b* and 9*c* also illustrate in the same manner, a stop block 91. Stop block 91 is attached to the triangular seat support 430. When seat 410 rotates back all the way, sensor 92, which is attached to the inner seat frame, detects stop block 91 and stops seat 410 from rotating back further. In various embodiments an optional electrical sensor (control interlock) may prevent seat 410 from rotating into a vertical position when footrest 510 is not fully retracted. In the same manner, the footrest 510 cannot be extended unless sensor 92 detects stop block 91 when seat 410 is fully in the seated horizontal position.

FIGS. 10*a* and 10*b* show optional patient lift components which can be used to support a patient using seat 410 with backrest 411. FIG. 10*a* represents seat 420 in the retracted and extended position. Torso lifts 450*a* and 450*b* are raised and lowered by linear actuators (not shown), mounted above each torso lift 450*a* and 450*b*. that are attached between the torso lifts 450*a* and 450*b* and the inner seat support frame. Torso lifts 450*a* and 450*b* are raised by retracting the actuators and extended by extending the actuators. FIG. 10*a* illustrates rigid support structures attached to torso lifts 450*a* and 450*b*. which slide under the patient's legs and/or buttocks to support the patient. FIG. 10*b* illustrates sling assemblies 37*a* and 37*b* which encircle patient's thighs and provide lift when torso lifts. Buttock support member 496 also attached to torso lifts 450*a* and 450*b* provides additional support to the buttock area, using a configuration of crossed straps in the embodiment shown. In the embodiment shown, sling assemblies 37*a* and 37*b* are attached to respective torso lifts 450*a* and 450*b*. As shown in FIG. 10*b*. buttock support member 496 is attached at each end to torso lifts 450*a* and 450*b*.

Figure 11:
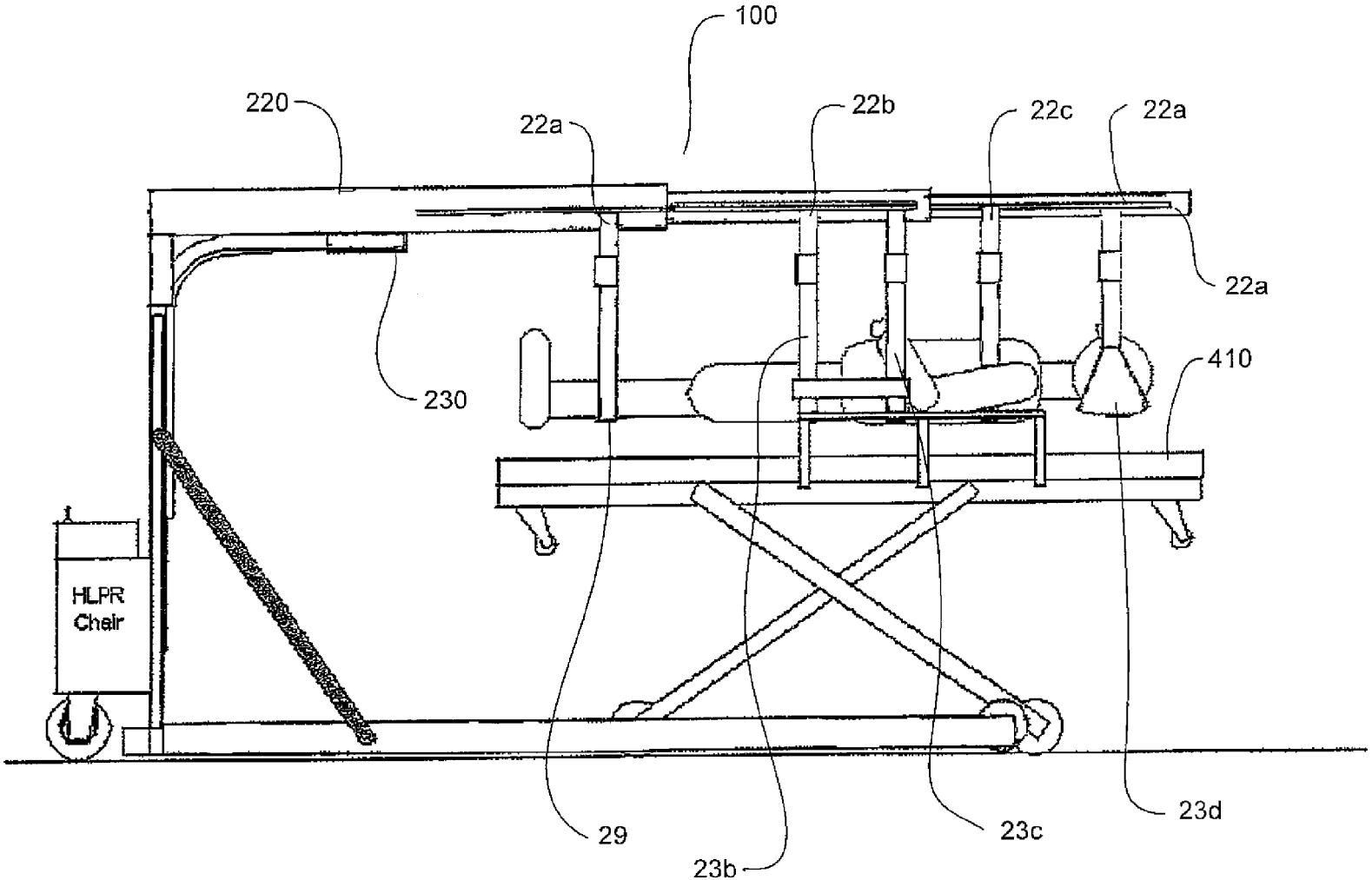
FIG. 11 illustrates an exemplary embodiment of an HLPR apparatus that may be used to move a patient from a transport vehicle.

FIG. 11 illustrates an alternate embodiment in which HLPR apparatus 100 is adapted to facilitate patient removal from vehicles by attaching to outer curved tubular base frame 220 telescoping components and to HLPR apparatus 100 base an apparatus torque prevention base that prevents HLPR apparatus 100 from tipping towards the patient. This telescoping capability allows HLPR apparatus 100 to "reach" inside an emergency or any other vehicle, raise and lower the telescoping components just above the patient lying inside the vehicle, manually strap the telescoping components to the patient, use the HLPR lift actuator, drive/steer wheel to lift and drive the patient from the vehicle and place them onto a gurney or to continue supporting the patient. In the embodiment shown, outer curved tubular base frame 220 further includes one or more slots 22*a*-22*d* used to support one or more adjustable hanging straps 23*a*-23*d* which can be used to lift and suspend a patient as shown in FIG. 11.

Figure 12:
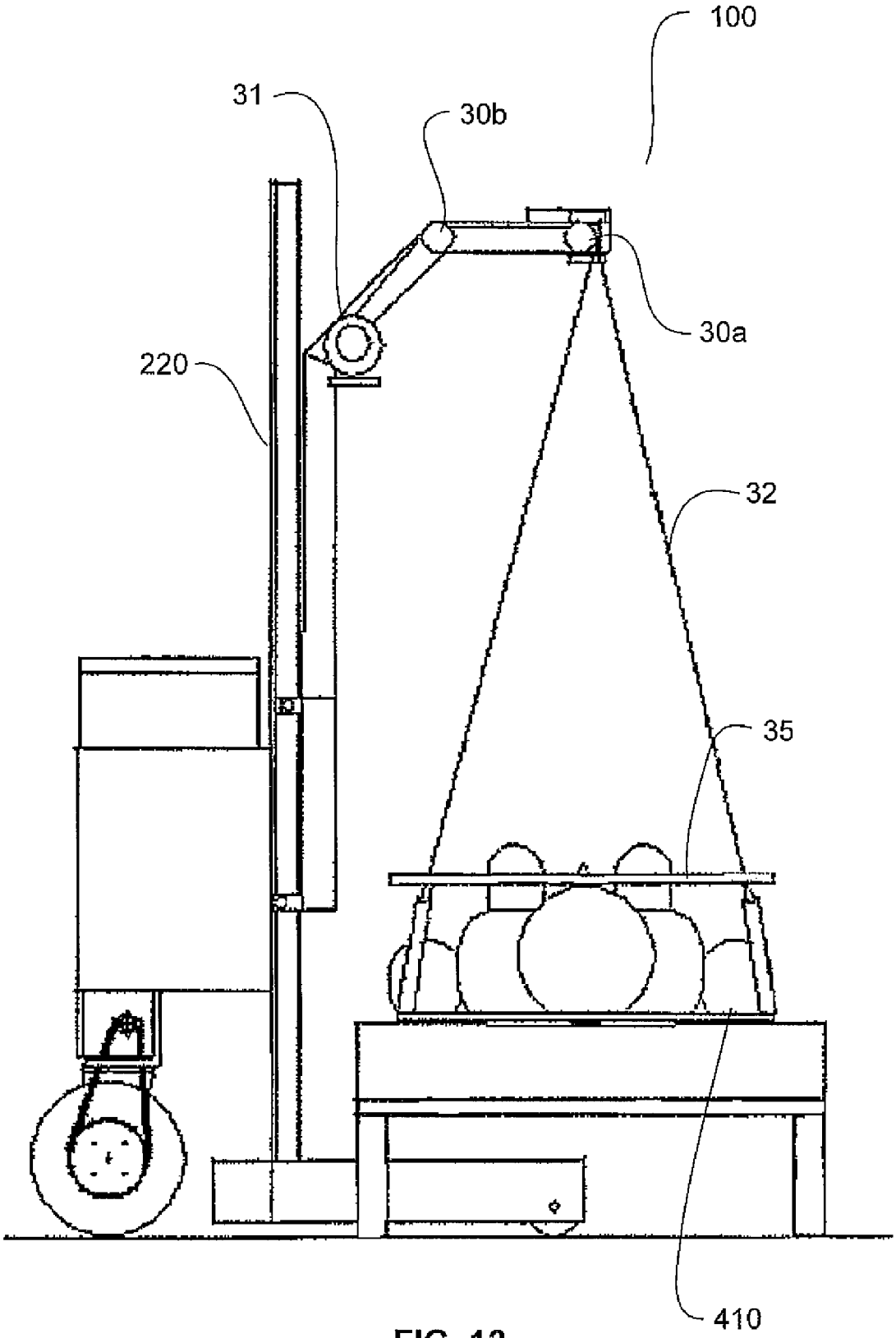
FIG. 12 illustrates an exemplary embodiment of an HLPR apparatus that utilizes an optional winch and cable (pulley) structure.

FIG. 12 illustrates an alternate embodiment of HLPR apparatus 100 that utilizes optional winch 31 and cable (pulley) structures 30*a* and 30*b* attached to a padded spreader bar 35. In the embodiment shown, winch cables 32 move around a pulley structure 33 to provide overhead lift capability. In the embodiment shown, support sling 37 is attached to outer curved tubular base frame 220 and/or curved inner base frame 230 to assist in lifting patients that are laying down (e.g. to move them to another bed or a sitting position). A combination (not shown) of the winch and cable pulley structure lift system with the HLPR seat system is also feasible to lift the patient to a seated position to be placed in the seat 410. FIG. 12 also illustrates the use of spreader bar 35 to maintain the open position of support sling 37 during lift of a patient when laying down and to assist a patient in sifting (not shown). This embodiment may be used to pick up large bariatric patients and patients in the laying down position. Inner curved tubular patient support frame 230 may further include a rotary joint (not shown) within one or more vertical extensions to allow the horizontal armrest(s) to rotate up to 90 degrees away from the seat 410 to allow large bariatric patients to access seat 410. If both arms are extended away from seat 410, HLPR apparatus 100 can be more easily used to access patients that are lying down.

Figure 13:
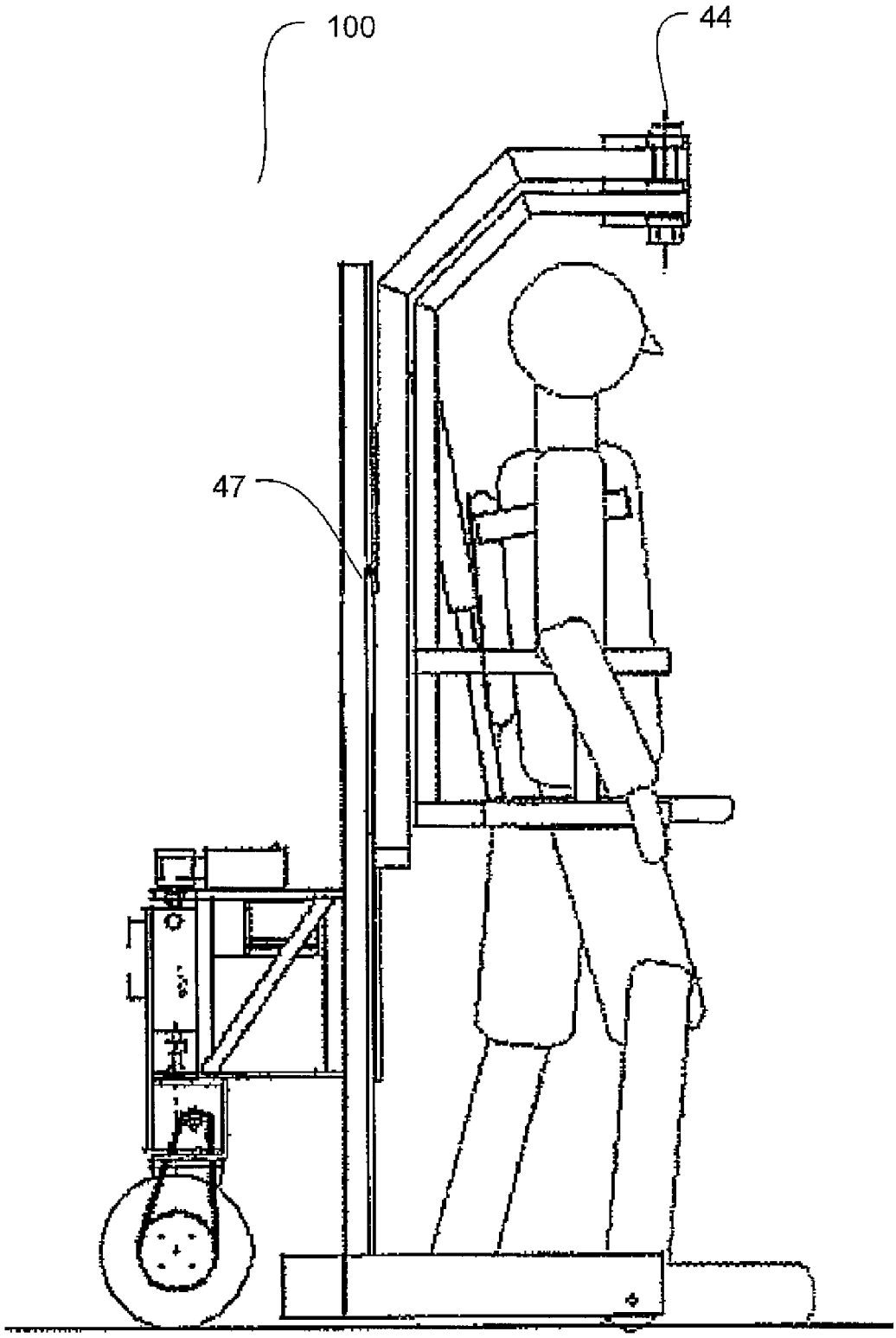
FIGS. 13 illustrates an exemplary embodiment of an HLPR apparatus adapted for rehabilitative purposes.

FIG. 13 illustrates a further embodiment of HLPR apparatus 100, which is used for rehabilitative purposes. In the embodiment shown, HLPR apparatus 100 includes load sensor 44 and control 47 on the lift actuator. These added components allow an ambulatory or semi-ambulatory patient to be supported when seat 410 (not shown) is retracted to a vertical position or removed. In various embodiments, an optional sling may be included to further support the patient.

What is claimed is:

1. A home lift position and rehabilitation (HLPR) apparatus capable of movement along an x-axis, z-axis, extended z-axis, inner rotational axis and y-axis comprised of:

an outer telescoping curved tubular base frame adapted to receive a tubular shaft;

a wheel assembly comprised of at least one wheel mounted in a wheel base housing and attached to said outer telescoping curved tubular base frame;

an inner curved tubular patient support frame having an overhead component adapted to receive a tubular shaft and pivotally nested within said outer telescoping curved tubular base frame;

a torque resistant pivot assembly comprised of a tubular shaft having a diameter of four to forty inches, said tubular shaft pivotally suspended into said outer telescoping curved tubular base frame and said inner curved tubular patient support frame, pivotally securing said inner curved tubular patient support frame to said outer telescoping curved tubular base frame, and secured by a weight-bearing circular ring attached to said tubular shaft and secured by a securing component;

and a patient support structure mounted to a lift plate which is securely attached to said outer curved tubular base frame.

2. The home lift position and rehabilitation (HLPR) apparatus of claim 1 which further includes at least one control set selected from a group consisting of a manually operated device, a lever, a joystick, a steering wheel, a computer interface, a voice activated, control a sensor, a sip-and-puff device, and an encoder.

3. The home lift position and rehabilitation (HLPR) apparatus of claim 1 wherein said lift plate is moved vertically by an actuator selected from a group consisting of an electric actuator, a motor, a hydraulic cylinder and a linear actuator.

4. The home lift position and rehabilitation (HLPR) apparatus of claim 1 wherein said outer telescoping curved tubular base frame is comprised of an upper vertical frame member and a lower vertical frame member.

5. The home lift position and rehabilitation (HLPR) apparatus of claim 1 wherein said outer telescoping curved tubular base frame is comprised of an upper vertical frame member having a first track structure and a lower vertical frame member having a second track structure, wherein said upper vertical frame member and said lower vertical frame member are movably attached along said first and second track structures.

6. The home lift position and rehabilitation (HLPR) apparatus of claim 1 wherein said torque resistant pivot assembly further includes at least one optional bearing ring positioned at a point between two components selected from a group consisting of said outer telescoping curved tubular base frame, said inner curved tubular patient support frame and said securing component.

7. The home lift position and rehabilitation (HLPR) apparatus of claim 1 wherein said torque resistant pivot assembly further includes at least one strengthening plate.

8. The home lift position and rehabilitation, (HLPR) apparatus of claim 1 wherein said patient support structure is a seat component which is fixably attached to said inner curved tubular patient support frame, and said inner curved tubular patient support frame is capable of moving along an inner rotational axis while said outer telescoping curved tubular base frame remains stationary.

9. The home lift position and rehabilitation (HLPR) apparatus of claim 8 that further includes a seat assembly that allows said seat component to retract from a horizontal to a vertical position and return to a horizontal position.

10. The home lift position and rehabilitation (HLPR) apparatus of claim 9 which further includes a spring assembly.

11. The home lift position and rehabilitation (HLPR) apparatus of claim 9 which further includes a seat sensor.

12. The home lift position and rehabilitation (HLPR) apparatus of claim 9 wherein said seat assembly further includes a seat actuator selected from a group consisting of an electric actuator, a motor, a hydraulic cylinder and a linear actuator.

13. The home lift position and rehabilitation (HLPR) apparatus of claim 1 which further includes at least one patient support structure selected from a group consisting of a chair, a stool, bed, table, examination table, gurney, cot, platform, hammock, sling support, sling support configuration, surgical table, partial seat support apparatus, walker, arm rest, and combinations thereof.

14. The home lift position and rehabilitation (HLPR) apparatus of claim 1 which further includes a footrest capable of retracting and pivoting from a horizontal to a vertical position: and returning to said horizontal position.

15. The home lift position and rehabilitation (HLPR) apparatus of claim 14 which further includes a footrest sensor.

16. The home lift position and rehabilitation (HLPR) apparatus of claim 14 which further includes a footrest actuator selected from a group consisting of an electric actuator, a motor, a hydraulic cylinder and a linear actuator.

17. The home lift position and rehabilitation (HLPR) apparatus of claim 1 which further includes a drive motor.

18. The home lift position and rehabilitation (HLPR) apparatus of claim 1 which further includes at least one mechanical lift component selected from a group consisting of at least one cable and winch assembly and at least one pulley.

19. The home lift position and rehabilitation (HLPR) apparatus of claim 1 which further includes at least one pulley.

20. The home lift position and rehabilitation (HLPR) apparatus of claim 1 wherein said outer telescoping curved tubular base frame further includes at least one telescoping horizontal overhead component.

21. A torque-resistant home lift position and rehabilitation (HLPR) apparatus capable of movement along an x-axis, z-axis, extended z-axis, inner rotational axis and y-axis comprised of:

an outer telescoping curved tubular base frame constructed of at least one lightweight, torque-resistant bent metal tubing component adapted to receive a tubular shaft;

a wheel assembly comprised of at least one drive wheel and at least one non-drive wheel and attached to said outer telescoping curved tubular base frame;

an inner curved tubular patient support frame constructed of lightweight, torque-resistant bent metal tubing having an overhead component adapted to receive a tubular shaft and pivotally nested within said outer telescoping curved tubular base frame;

a torque resistant pivot assembly comprised of a tubular shaft having a diameter of four to forty inches, said tubular shaft pivotally suspended into said outer telescoping curved tubular base frame and said inner curved tubular patient support frame, pivotally securing said inner curved tubular patient support frame to said outer telescoping curved tubular base frame, and secured by a weight-bearing circular ring attached to said tubular shaft and secured by a securing component;

and a patient support structure mounted to a lift plate which is securely attached to said outer telescoping curved tubular base frame.

22. The home lift position and rehabilitation (HLPR) apparatus of claim 21 which further includes at least one lift actuator attached to said lift plate.

23. The home lift position and rehabilitation (HLPR) apparatus of claim 21 wherein said patient support component is a seat component which is attached to said inner curved tubular patient support frame, and said inner curved tubular patient support frame is capable of moving along an inner rotational axis while said outer telescoping curved tubular base frame remains stationary.

24. The home lift position and rehabilitation (HLPR) apparatus of claim 23 which further includes a seat assembly which allows said seat component to retract and pivot from a horizontal to a vertical position.

25. The home lift position and rehabilitation (HLPR) apparatus of claim 24 which further includes at least one spring assembly.

26. The home lift position and rehabilitation (HLPR) apparatus of claim 24 which further includes at least one seat actuator.

27. The home lift position and rehabilitation (HLPR) apparatus of claim 21 wherein said patient support structure is selected from a group consisting of a chair, a stool, bed, table, examination table, gurney, cot, platform, hammock, sling support, sling support configuration, surgical table, partial seat support apparatus, walker, arm rest, and combinations thereof.

28. The home lift position and rehabilitation (HLPR) apparatus of claim 21 which further includes a footrest.

29. The home lift position and rehabilitation (HLPR) apparatus of claim 28 wherein said footrest is capable of retracting and pivoting from a horizontal to a vertical position and returning to said horizontal position.

30. The home lift position and rehabilitation (HLPR) apparatus of claim 21 which further includes a drive motor.

31. The home lift position and rehabilitation (HLPR) apparatus of claim 21 which further includes at least one mechanical component selected from a group consisting of at least one cable and winch assembly and at least one pulley.

32. The home lift position and rehabilitation (HLPR) apparatus of claim 21 which further includes at least one pulley.

33. The home lift position and rehabilitation (HLPR) apparatus of claim 21 which further includes at least one telescoping horizontal overhead component.

34. A torque-resistant home lift position and rehabilitation (HLPR) apparatus capable of movement along an x-axis, z-axis, extended z-axis, inner rotational axis and y-axis comprised of:

an outer telescoping curved tubular base frame constructed of at least one lightweight, torque-resistant bent metal tubing component adapted to receive a tubular shaft;

a wheel assembly comprised of at least one drive wheel and at least one non-drive wheel and attached to said outer telescoping curved tubular base frame;

an inner curved tubular patient support frame constructed of lightweight; torque-resistant bent metal tubing having an overhead component adapted to receive a tubular shaft and pivotally nested within said outer telescoping curved tubular base frame;

a torque resistant pivot assembly comprised of a tubular shaft having a diameter of four to forty inches, said tubular shaft pivotally suspended into said outer telescoping curved tubular base frame and said inner curved tubular patient support frame, pivotally securing said inner curved tubular patient support frame to said outer telescoping curved tubular base frame, and secured by a weight-bearing circular ring attached to said tubular shaft and secured by a securing component;

at least one drive motor;

and a patient support structure mounted to a lift plate which is securely attached to said outer telescoping curved tubular base frame.

35. The home lift position and rehabilitation (HLPR) apparatus of claim 34 which further includes at least one telescoping horizontal overhead component capable of supporting at least one interchangeable patient support structure selected from a group consisting of a chair, a seat, a stool, bed, table, examination table, gurney, cot, platform, hammock, sling support, sling support configuration, surgical table, partial seat support apparatus, walker, arm rest, and combinations thereof.

36. The home lift position and rehabilitation (HLPR) apparatus of claim 34 wherein said patient support structure is a seat that allows said seat component to retract from a horizontal to a vertical position to allow a user to assume a standing position.

* * * * *